United States Patent [19]

Coombs et al.

[11] 4,045,158

[45] Aug. 30, 1977

[54] BURNER ASSEMBLY

[75] Inventors: Donald L. Coombs; Richard E. Hollis, both of Springfield, Ohio

[73] Assignee: International Telephone and Telegraph Corporation, New York, N.Y.

[21] Appl. No.: 696,784

[22] Filed: June 16, 1976

[51] Int. Cl.[2] ..... F24C 5/02

[52] U.S. Cl. ..... 431/123; 126/43; 239/582; 251/82

[58] Field of Search ..... 126/43; 431/225, 123, 431/344, 122; 239/581, 582, 458; 251/215, 216, 84, 85, 162, 167, 168, 197, 203, 204, 82

[56] References Cited

U.S. PATENT DOCUMENTS

| | | | |
|---|---|---|---|
| 3,273,851 | 9/1966 | Rosch et al. | 251/204 X |
| 3,467,355 | 9/1969 | Burke | 251/204 X |
| 3,643,917 | 2/1972 | Griffiths et al. | 251/215 |
| Re. 11,115 | 10/1890 | Porteous | 251/197 |

*Primary Examiner*—Edward G. Favors
*Attorney, Agent, or Firm*—Thomas L. Peterson

[57] ABSTRACT

A burner assembly for liquid fuels in which a body member is rotatable about a central stem member and movable axially thereof to open a fuel valve and also to move a flow control member extending into a nozzle opening on the body member. The fuel valve comprises a poppet valve element in the fuel passage above a valve seat formed in the passage. When the nozzle opening is closed, the poppet valve element is pushed against the valve seat by engagement thereof with the body member, which closes the fuel passage thereby assuring no leakage of fuel from the burner assembly.

5 Claims, 1 Drawing Figure

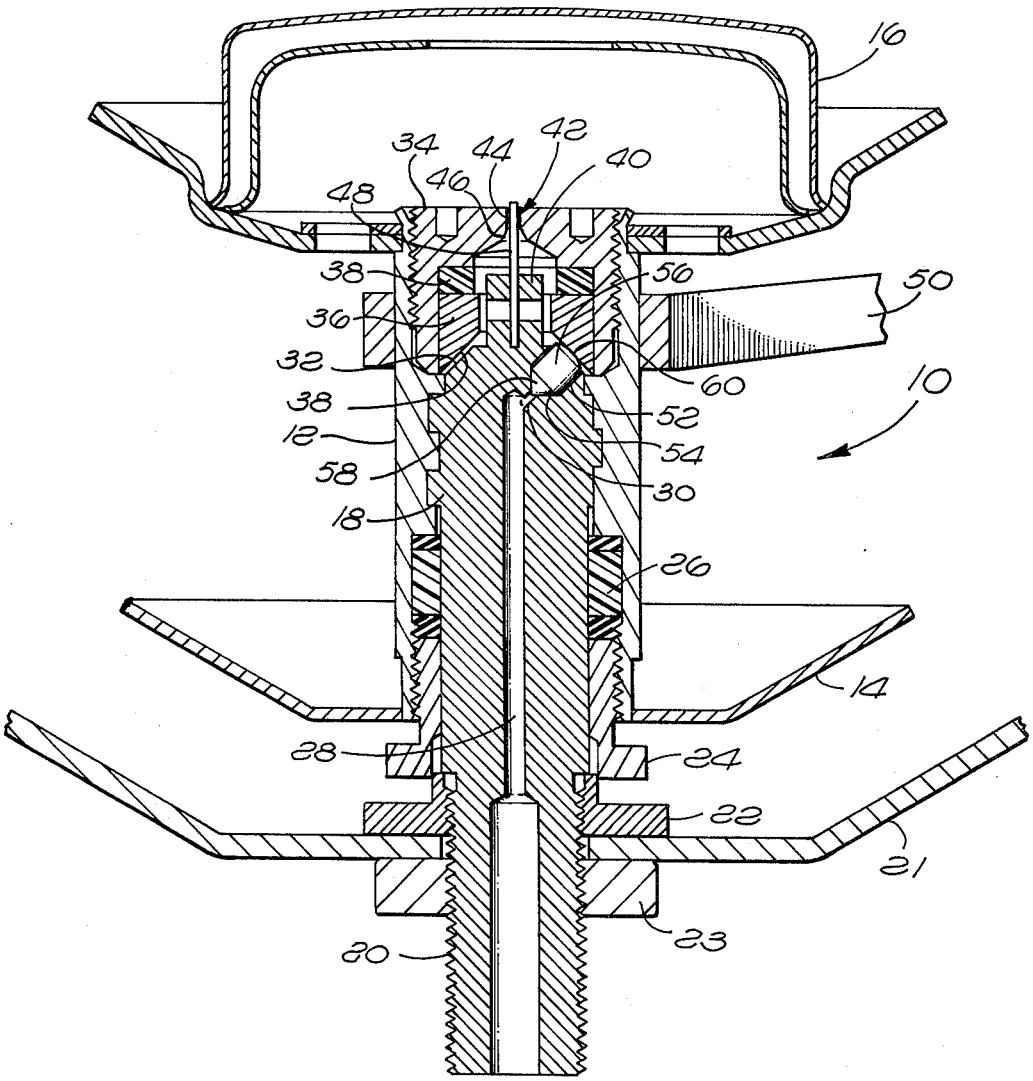
16
34
44
42
40
46
48
38
56
50
36
32
60
10
38
52
12
54
58
30
18
26
14
28
24
22
21
23
20

BURNER ASSEMBLY

BACKGROUND OF THE INVENTION

The present invention relates generally to a burner assembly and, more particularly, to a burner assembly for a stove which utilizes a liquid fuel such as alcohol.

The present invention constitutes an improvement upon the burner assembly disclosed in U.S. Pat. No. Re28,730 to Finnstrand. The Finnstrand patent discloses a stove body or pan having a burner mounted therein together with a control rod and handle attached to a body member of the burner and adapted to rotate the body to control the flow of fuel. Fuel is supplied to a stationary central stem member inside the body member. The body member is rotatable and longitudinally movable with respect to the burner stem to open a valve to emit fuel to a nozzle and also to control the amount of fuel exiting from the nozzle by controlling the area thereof.

The fuel valve in the assembly comprises mating tapered surfaces on the body member and central stem member which must be accurately matched in order for the fuel passage that opens at the stem member tapered surface to be closed. If the tapered surfaces do not accurately mate, due to failure in maintaining manufacturing tolerances or distortion of the parts during use of the burner assembly, leakage of fuel may occur either at the top of the nozzle of the assembly or at the base of the central stem member.

It is the purpose of the present invention to overcome the fuel leakage problem which exists in the prior burner assembly.

SUMMARY OF THE INVENTION

According to the principal aspect of the present invention, a burner assembly of the type disclosed in the aforementioned Finnstrand patent is modified by providing a valve seat in the fuel passage adjacent to the tapered surface of the stem member. A poppet valve element is mounted in the fuel passage above the valve seat. When the body member and central stem member are rotated relative to each other to close the nozzle opening of the burner assembly, the tapered surface on the body member engages the outer end of the poppet valve element, pushing the poppet valve element inwardly against the valve seat to close the fuel passage, theereby providing a positive, leak-free closure of the fuel passage so that no leakage of fuel will occur in the burner assembly. The poppet valve element is loosely mounted in the fuel passage so that when the body member is rotated relative to the stem member to open the valve, the poppet element is free to lift off the valve seat under the pressure of fuel in the fuel passage in the stem member. Thus, by the present invention, leakage of fuel is avoided by a simple and inexpensive modification of the prior art burner assembly.

BRIEF DESCRIPTION OF THE DRAWING

The drawing illustrates the burner assembly of the present invention in partial longitudinal section.

DESCRIPTION OF THE PREFERRED EMBODIMENT

The burner assembly of the present invention, generally designated 10, comprises a burner body 12 having a preheat dish or cup member 14 mounted on its lower end and a head 16 mounted on its upper end. A central stem 18 is mounted within the burner body 12. The stem has a lower portion 20 adapted to receive a coupling to a fuel line, not shown. The body 12 is threadedly attached to the stem 18 and movable longitudinally with respect thereto. The stem 18 is supported on a pan 21 by means of a flanged nut 22 and lower nut 23 threadedly engaged with the stem. A nut 24 threaded into the lower end of the body 12 is slidable axially with respect to the flanged nut 22. A packing gland or seal 26 is provided in the body above the nut 24.

A longitudinally extending fuel passage 28 is provided in the stem member 18 and opens at its lower end. The upper end of the passage 28 includes an upwardly extending section 30 which opens at a tapered or frusto conical surface 32 on the stem.

A nozzle 34 is threaded into the upper end of the body 12. An annular insert 36 is mounted in the nozzle 34. The insert has a tapered surface 38 which generally matches the tapered surface 32 on the stem 18. A resilient packing ring 38 is located in the nozzle above the insert 36. The insert 36 and ring 38 surround an upper cylindrical projection 40 on the stem 18, but are spaced therefrom to permit fuel to flow therebetween to a centrally located opening 42 in the nozzle 34. The opening comprises an upper cylindrical portion 44 and lower tapered portion 46. A needle 48 is mounted in the projection 40 on the stem 18 and extends into the opening 42. The cylindrical section 44 of the opening has an area only slightly larger than the cross-sectional area of the needle.

A lever 50 is connected to the body member 12 for rotating the body member relative to the stem member 18 so that the two members may be axially moved relative to each other.

The structure described so far is essentially identical to that disclosed in the aforementioned Finnstrand patent. As mentioned previously herein, in the Finnstrand burner the fuel valve consists of the mating of the tapered surfaces 32 and 38 on the stem 18 and body 12, respectively, which, when mated together, close the inclined section 30 of the fuel passage 28. However, the tapered surfaces 32 and 38 do not always match so that leakage may occur in the valve with the result that fuel may leak out of the burner either at the passage 42 in the nozzle 34 or in the region of the packing gland 26.

In accordance with the present invention, the fuel passage section 30 is enlarged to provide a cylindrical recess 52 which terminates in a tapered valve seat 54. A poppet valve element 56 is loosely mounted in the recess 52. The poppet valve element comprises a cylindrical body having a diameter less than the diameter of the recess 52 so that fuel may flow through the space between the wall of the recess and the poppet valve element. The inner end 58 of the poppet valve element has a conical configuration shaped to engage the valve seat 54 and close the passage 30 when the poppet valve element is pushed inwardly toward the seat. The poppet valve element 56 is sufficiently long so that the outer rounded end 60 thereof extends beyond the tapered surface 32 on the stem 18.

In the position of the various components of the burner assembly illustrated in the drawing, the needle 48 extends through the opening 42 to close the nozzle opening and the tapered surface 38 on the insert 36, engages the outer rounded end 60 of the poppet valve element 56, pushing the inner conical end 58 of the element 56 against the valve seat 54 to thereby close the fuel passage 28. This valve arrangement assures a positive closure of the fuel passage so that no leakage of fuel will occur in the burner. In order to open the fuel passage 28, the lever 50 is actuated to rotate the body member 12 relative to the central stem 18 causing the two members to move axially relative to each other so that the tapered surfaces 32 and 38 will separate. Such movement of the members 12 and 18 causes the tapered surface 38 on the insert 36 to move upwardly away from the poppet valve element 56, thereby allowing the element to be lifted off the valve seat 54 by the pressure of the fuel in the passage 28. Also, during such relative movement between the members 12 and 18, the needle 48 will retract so that its end is located in the tapered portion 46 of the nozzle opening 42 so that the fuel may flow through the opening. With the parts in the position as just described, fuel may flow upwardly through the passage 28, passage section 30, around the poppet valve element 46, upwardly through the space between the insert 36 and projection 40 on the stem member, and from there upwardly around the needle 48 and outwardly through the upper cylindrical section 44 of the nozzle opening 42.

While the opposed surfaces 32 and 38 on the stem member 18 and insert 36 are shown as being tapered, it will be appreciated that such surfaces could extend radially and the fuel passage 28 could be arranged to open vertically at the radially extending surfaces on the stem. Other modifications and variations of the invention will be apparent to those skilled in the art.

What is claimed is:

1. A burner assembly for liquid fuels comprising a stem member having a fuel passage therein, a body member engaging said stem member and axially movable thereon upon relative rotation therebetween, means providing a valve between said stem member and said body member, said body member including a nozzle having a nozzle opening therein, a needle carried by said stem member, said needle extending into said nozzle opening to close said opening when said valve means is in a closed position and being retractable to control said nozzle opening when said body member is moved relative to said stem member to open said valve means, said valve means comprising:

a generally transversely extending surface on said stem member, said fuel passage opening at said surface;

a valve seat in said fuel passage below said surface;

a poppet valve element loosely mounted in said fuel passage above said seat; and said body member engaging said poppet valve element pushing said element against said valve seat to close said fuel passage when said needle closes said nozzle opening.

2. A burner assembly as set forth in claim 1 wherein:

said body member embodies a generally transversely extending surface opposite to said stem member surface, said surfaces being movable toward each other when said valve means is being closed; and said body member surface engaging said poppet valve element to push said element against said seat.

3. A burner assembly as set forth in claim 2 wherein:

said surfaces are tapered generally mating surfaces.

4. A burner assembly as set forth in claim 1 wherein:

said nozzle opening has an upper cylindrical portion and a lower tapered portion.

5. A burner assembly for liquid fuels comprising:

a stem member having a fuel passage extending lengthwise therein;

a body member engaging said stem member and axially movable thereon upon relative rotation therebetween, said body member including a nozzle having a nozzle opening;

a needle carried by said stem member extending into said nozzle opening;

generally transversely extending opposed surfaces on said body member and said stem member;

said fuel passage opening at said stem member surface;

a valve seat in said fuel passage;

a poppet valve element loosely mounted in said fuel passage having one end adapted to engage said valve seat and an opposite end extending beyond said stem member surface adapted to be engaged by said body member surface;

when said body member is rotated in one direction relative to said stem member, said body member surface engages said opposite end of said poppet valve element causing said one end thereof to engage said valve seat to thereby prevent leakage of fuel from said fuel passage to said nozzle, and said needle valve closes said nozzle opening; and when said body member is rotated in the opposite direction relative to said stem member, said opposed surfaces separate to allow said poppet valve element to lift off said valve seat, and said needle retracts to control said nozzle opening.

* * * * *